US010119681B2

(12) United States Patent
Wehlus

(10) Patent No.: US 10,119,681 B2
(45) Date of Patent: Nov. 6, 2018

(54) LUMINAIRE AND ARRANGEMENT WITH A PLURALITY OF LUMINAIRES

(71) Applicant: OSRAM OLED GmbH, Regensburg (DE)

(72) Inventor: Thomas Wehlus, Lappersdorf (DE)

(73) Assignee: OSRAM OLED GmbH (DE)

( * ) Notice: Subject to any disclaimer, the term of this patent is extended or adjusted under 35 U.S.C. 154(b) by 0 days.

(21) Appl. No.: 15/566,787

(22) PCT Filed: Apr. 7, 2016

(86) PCT No.: PCT/EP2016/057568
§ 371 (c)(1),
(2) Date: Oct. 16, 2017

(87) PCT Pub. No.: WO2016/166004
PCT Pub. Date: Oct. 20, 2016

(65) Prior Publication Data

US 2018/0087743 A1 Mar. 29, 2018

(30) Foreign Application Priority Data

Apr. 16, 2015 (DE) ..... 10 2015 105 835

(51) Int. Cl.
*F21V 1/00* (2006.01)
*F21V 11/00* (2015.01)
(Continued)

(52) U.S. Cl.
CPC ..... *F21V 7/04* (2013.01); *F21S 2/005* (2013.01); *F21V 3/00* (2013.01); *F21V 7/0058* (2013.01); *F21Y 2115/15* (2016.08)

(58) Field of Classification Search
USPC ..... 362/235
See application file for complete search history.

(56) References Cited

U.S. PATENT DOCUMENTS

2006/0152931 A1 7/2006 Holman
2006/0187661 A1* 8/2006 Holten ..... F21V 7/0008 362/298

(Continued)

FOREIGN PATENT DOCUMENTS

DE 10 2009 001 061 A1 8/2010
WO 2011/027267 A1 3/2011
WO 2012/110718 A1 8/2012

*Primary Examiner* — Tuyen K Vo
(74) *Attorney, Agent, or Firm* — DLA Piper LLP (US)

(57) ABSTRACT

A luminaire includes a surface light source that emits light with a plane, effective emission surface E, from which the light generated in the surface light source is radiated, a reflector configured to suppress glare of the surface light source for emission angles above a glare angle a, with $40° \leq a \leq 80°$, and a plane, effective radiation surface F, from which light emitted by the surface light source emerges from the luminaire, wherein the emission surface is surrounded on all sides by the reflector and the reflector, starting from the emission surface, extends towards the radiation surface, the reflector, in a cross-sectional view perpendicular to the emission surface, is formed concave on average so that a width b of the reflector in a direction away from the emission surface is described by a function f (b) and the first derivative f' (b) thereof increases either strictly monotonically or as an alternative monotonically as well as strictly monotonically in some places in the direction away from the emission surface, it applies with a tolerance of 5% at most: $F=E/\sin^2(a)$ with $E \geq 1\ cm^2$, on at least one intersection line parallel to and in the emission surface, it applies for a height H of the reflector in the direction perpendicular to the emission surface with a tolerance of 10% at most: $H=\tan(90°-a)\ L$, and L is a length of the intersection line from an edge of the emission surface facing away from the reflector to the edge of the facing radiation surface, in a plan view.

16 Claims, 4 Drawing Sheets

(51) Int. Cl.

| | |
|---|---|
| ***F21V 7/04*** | (2006.01) |
| ***F21V 7/00*** | (2006.01) |
| ***F21V 3/00*** | (2015.01) |
| ***F21S 2/00*** | (2016.01) |
| *F21Y 115/15* | (2016.01) |

(56) References Cited

U.S. PATENT DOCUMENTS

| | | | | |
|---|---|---|---|---|
| 2008/0278943 | A1* | 11/2008 | Van Der Poel | F21V 7/0008 362/240 |
| 2012/0112614 | A1 | 5/2012 | Pickard et al. | |
| 2013/0039090 | A1 | 2/2013 | Dau et al. | |
| 2013/0301249 | A1 | 11/2013 | Ngai et al. | |
| 2013/0308294 | A1 | 11/2013 | Nezu et al. | |
| 2014/0063792 | A1 | 3/2014 | Spencer et al. | |
| 2014/0334126 | A1 | 11/2014 | Speier et al. | |
| 2015/0285461 | A1* | 10/2015 | Chen | F21V 7/0091 362/235 |

* cited by examiner

A)

B)

C)

A)

B)

A)

B)

C)

LUMINAIRE AND ARRANGEMENT WITH A PLURALITY OF LUMINAIRES

TECHNICAL FIELD

This disclosure relates to a luminaire and an assembly having a plurality of such luminaires.

BACKGROUND

There is a need to provide a luminaire in which an organic light-emitting diode can be used in an efficient and glare-free manner.

SUMMARY

I provide a luminaire including a surface light source that emits light with a plane, effective emission surface E, from which the light generated in the surface light source is radiated, a reflector configured to suppress glare of the surface light source for emission angles above a glare angle a, with 40°≤a≤80°, and a plane, effective radiation surface F. from which light emitted by the surface light source emerges from the luminaire, wherein the emission surface is surrounded on all sides by the reflector and the reflector, starting from the emission surface, extends towards the radiation surface, the reflector, in a cross-sectional view perpendicular to the emission surface, is formed concave on average so that a width b of the reflector in a direction away from the emission surface is described by a function f (b) and the first derivative f' (b) thereof increases either strictly monotonically or as an alternative monotonically as well as strictly monotonically in some places in the direction away from the emission surface, it applies with a tolerance of 5% at most: $F=E/\sin^2(a)$ with $E\geq 1\ cm^2$, on at least one intersection line parallel to and in the emission surface, it applies for a height H of the reflector in the direction perpendicular to the emission surface with a tolerance of 10% at most: H=tan(90°−a) L, and L is a length of the intersection line from an edge of the emission surface facing away from the reflector to the edge of the facing radiation surface, in a plan view.

I also provide an assembly having a plurality of the luminaires including a surface light source that emits light with a plane, effective emission surface E, from which the light generated in the surface light source is radiated, a reflector configured to suppress glare of the surface light source for emission angles above a glare angle a, with 40°≤a≤80°, and a plane, effective radiation surface F. from which light emitted by the surface light source emerges from the luminaire, wherein the emission surface is surrounded on all sides by the reflector and the reflector, starting from the emission surface, extends towards the radiation surface, the reflector, in a cross-sectional view perpendicular to the emission surface, is formed concave on average so that a width b of the reflector in a direction away from the emission surface is described by a function f (b) and the first derivative f' (b) thereof increases either strictly monotonically or as an alternative monotonically as well as strictly monotonically in some places in the direction away from the emission surface, it applies with a tolerance of 5% at most: $F=E/\sin^2(a)$ with $E\geq 1\ cm^2$, on at least one intersection line parallel to and in the emission surface, it applies for a height H of the reflector in the direction perpendicular to the emission surface with a tolerance of 10% at most: H=tan(90°−a) L, and L is a length of the intersection line from an edge of the emission surface facing away from the reflector to the edge of the facing radiation surface, in a plan view, wherein the surface light source is an organic light-emitting diode and the luminaires are arranged laterally next to one another in a common plane.

I further provide a luminaire including an organic light-emitting diode that emits light with a plane, effective emission surface E, from which the light generated in the organic light-emitting diode is radiated, a reflector configured to suppress glare of the light-emitting diode for emission angles above a glare angle a, with 40°≤a≤80°, and a plane, effective radiation surface F. from which light emitted by the light-emitting diode emerges from the luminaire, wherein the emission surface is surrounded on all sides by the reflector and the reflector, starting from the emission surface, extends towards the radiation surface, the reflector, in a cross-sectional view perpendicular to the emission surface, is formed concave on average so that a width b of the reflector in the direction away from the emission surface is described by a function f (b) and the first derivative f' (b) thereof increases either strictly monotonically or as an alternative monotonically as well as strictly monotonically in some places in the direction away from the emission surface, it applies with a tolerance of 5% at most: $F=E/\sin^2(a)$ with $E\geq 1\ cm^2$, on at least one intersection line parallel to and in the emission surface, it applies for a height H of the reflector in the direction perpendicular to the emission surface with a tolerance of 10% at most: H=tan(90°−a) L, and L is a length of the intersection line from an edge of the emission surface facing away from the reflector to the edge of the facing radiation surface, in a plan view.

BRIEF DESCRIPTION OF THE DRAWINGS

FIGS. 1A-1C and 2 to 8A-8B are schematic illustrations of examples of luminaires described herein.

LIST OF REFERENCE CHARACTERS

Figure 1:
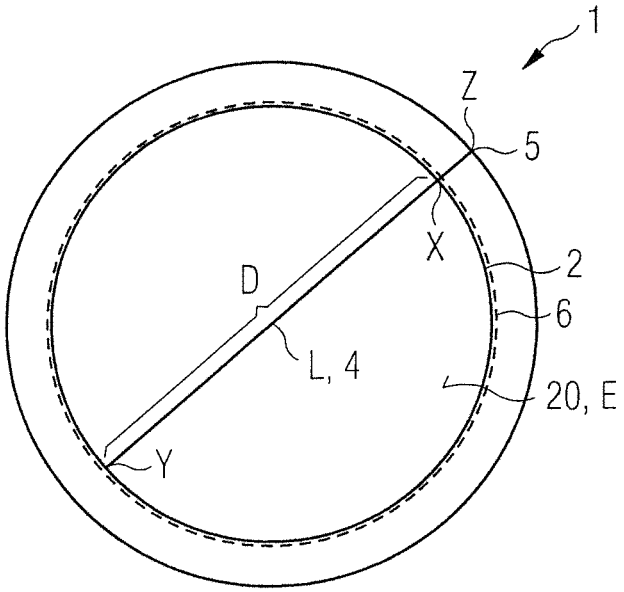
Figure 1:
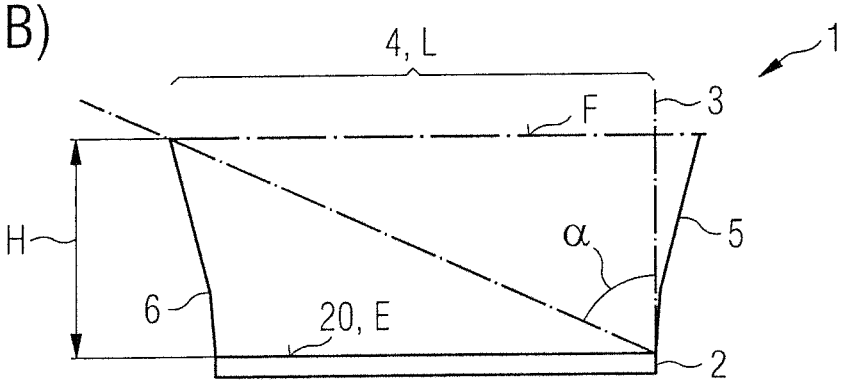
Figure 1:
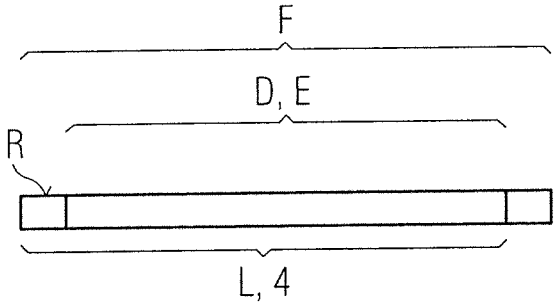

100 Assembly
1 Luminaire
2 Organic light-emitting diode
20 Light exit surface
3 Perpendicular to the emission surface
4 Intersection line
5 Reflector
6 Kink
7 Cover element
a Glare angle
D Average diameter of the emission surface
E Planar, effective emission surface of the light-emitting diode
F Planar, effective radiation surface of the luminaire
H Height of the reflector
L Length of the intersection line
R Emitted light
X Point
Y Point
Z Point

DETAILED DESCRIPTION

My luminaire is configured to generate visible light, e.g. white light. Preferably, the luminaire is configured for the purpose of general lighting. In particular, the luminaire is a ceiling lamp or a suspended luminaire mounted on or below a ceiling of a room and configured for lighting this room. In particular, the room is a living room or an office.

The luminaire may include one or multiple organic light-emitting diodes. The at least one organic light-emitting diode is configured to generate and emit the light output by the luminaire. In particular, at least 90% or 95% or 99% or the entire light output by the luminaire is generated by the at least one organic light-emitting diode. In other words, the organic light-emitting diode is the main light source of the luminaire then. In the at least one organic light-emitting diode, the light is generated in an organic layer sequence.

The organic light-emitting diode may comprise a plane, effective emission surface. The plane, effective emission surface will hereinafter also be referred to with E. The light generated in the organic light-emitting diode is radiated from the effective emission surface. The effective emission surface can be a real boundary surface of the organic light-emitting diode. Just as well, the effective emission surface can be a virtual surface corresponding to a surface of the organic light-emitting diode in a plan view. In particular, the effective emission surface is a projection of a light-emitting surface of the organic light-emitting diode on to a plane perpendicular to a main radiation direction of the organic light-emitting diode. In this case, the plane intersects the organic light-emitting diode preferably in at least one point so that this plane contacts the organic light-emitting diode, in particular tangentially, coming from a direction opposite the main radiation direction.

The luminaire may include a reflector. The reflector is configured to suppress glare of the organic light-emitting diode. In particular, the reflector is configured to suppress glare for emission angles above a glare angle, hereinafter also referred to with a. The glare angle may be the same for all directions. The glare angle preferably relates to the main radiation direction and/or to a perpendicular to the effective emission surface of the organic light-emitting diode. Light will then not be emitted by the organic light-emitting diode at angles greater than the glare angle. The glare angle is 60°, for example.

The luminaire may include a plane, effective radiation surface, hereinafter also referred to with F. The plane, effective radiation surface is a surface of the luminaire from which the light emitted by the light-emitting diode emerges from the luminaire. The effective radiation surface can be a real boundary surface of the luminaire formed of a solid material. However, preferably it is a virtual surface resulting from a plan view of the luminaire.

The effective radiation surface may be a sum of the effective emission surface of the organic light-emitting diode and the surface of the reflector, in a plan view. Here, the emission surface of the organic light-emitting diode and the surface of the reflector preferably do not overlap, but in particular contact each other on all sides, in a plan view.

The emission surface of the organic light-emitting diode may be surrounded by the reflector on all sides. This can mean that the reflector forms a closed ring around the emission surface. Here, the term closed ring relates to the optical function of the reflector. This does not exclude when, due to manufacture, there is a small gap in a place in the reflector with no light or no significant light fraction emerging from this gap.

The reflector may extend toward the radiation surface from the emission surface. In particular, the reflectors starts at the emission surface on all sides and in a contiguous manner so that the reflector contacts the emission surface on all sides then. It is not necessarily required that the reflector reaches the radiation surface in all places. However, this is the case in at least one point, and preferably also contiguously and on all sides, especially in organic light-emitting diodes formed to be rotation-symmetrical.

The reflector may be formed completely concave or concave on average, in a cross-sectional view perpendicular to the emission surface, i.e. a width of the reflector in the direction away from the emission surface increases or increases on average. Preferably, the width of the reflector increases monotonically or strictly monotonically in the direction away from the emission surface and in a cross-sectional view. Here, concave particularly means that a width b of the reflector in the direction away from the emission surface is described by a function f(b), and that the first derivative f'(b) of the function f(b) increases either strictly monotonically or monotonically and strictly monotonically in some places in the direction away from the emission surface. In other words, the reflector can widen-up at an increasing rate in the direction away from the emission surface. Here, the width b is particularly measured in the direction parallel to the emission surface. This relationship regarding the width b applies to at least one or, particularly preferably, to each cross-section through the reflector.

The emission surface may have a size of at least 1 $cm^2$ or 10 $cm^2$ or 80 $cm^2$ or 200 $cm^2$ or 0.5 $m^2$. In other words, the organic light-emitting diode is a surface light source. Preferably, the emission surface is a single contiguous emission surface without sub-divided, separately controllable emission areas. In other words, the organic light-emitting diode and thus the luminaire is not a pixelated display and not a pixelated display device.

The following relation may apply with respect to the emission surface E of the organic light-emitting diode and to the effective radiation surface F of the luminaire regarding the glare angle a: $F=E/\sin^2(a)$. Preferably, this relation applies with a tolerance of at most 5% or 2% or 1% or 0.5%. In particular, this relation applies exactly, within manufacturing tolerances. In other words, the emission surface is scaled to the radiation surface through the glare angle.

The following relation may apply to at least one or a plurality of or to all intersection lines parallel to the emission surface and to a height H of the reflector extending in the emission surface and in the direction perpendicular to the emission surface of the organic light-emitting diode: $H=\tan(90°-a)\,L$. This relation preferably applies with a tolerance of at most 10% or 5% or 2% or 1% or 0.5% or exactly, within manufacturing tolerances.

Here, L is a length of the intersection line from an edge of the emission surface facing away from the reflector to the edge of the facing radiation surface, in a plan view. In other words, the length L of the intersection line is determined as follows: In a plan view, an intersection line is placed through the emission surface of the organic light-emitting diode. In particular, the intersection line is the longest-possible intersection line, with respect to a respective point on the edge of the emission surface, wherein the height H of the reflector is to be determined in this point. Alternatively, or in addition, the intersection line is oriented perpendicular to the point where the height H of the reflector is to be determined. Starting from this point, where the reflector height is to be determined, the intersection line is calculated all the way to the further point of intersection of the intersection line with the emission surface as well as on the other hand all the way to the intersection of the intersection line with the radiation surface boundary, which bounds this point where the height of the reflector is to be determined.

The luminaire may include an organic light-emitting diode that emits light having a plane, effective emission surface E, from which the light generated in the organic light-emitting diode is radiated. Furthermore, the luminaire includes a reflector configured to suppress glare of the light-emitting diode for emission angles above a glare angle a. Furthermore, the luminaire comprises a plane effective radiation surface F, from which light emitted from the light-emitting diode emerges from the luminaire. The emission surface is surrounded by the reflector on all sides and the reflector extends towards the radiation surface from the emission surface. In a cross-sectional view perpendicular to the emission surface, the reflector is concave on average. It applies with a tolerance of at most 5%: $F=E/\sin^2(a)$ with $E\geq 1$ $cm^2$, wherein it also applies for a height H of the reflector in the direction perpendicular to the emission surface on at least one intersection line parallel to and in the emission surface, with a tolerance of at most 10%: $H=\tan(90°-a)$ L. Here, L is a length of the intersection line from an edge of the emission surface facing away from the reflector to the edge of the facing radiation surface, in a plan view.

Organic light-emitting diodes are surface light sources that are approximately Lambert emitters. In other words, light-emitting diodes emit approximately with a $\cos^2\theta$ characteristic. Thus, a significant radiation fraction at angles almost parallel to an emission surface is also emitted by organic light-emitting diodes. On the other hand, lighting conditions are standardized and regulated for offices, for example. Thus, a luminance must not be above 1500 nits at angles above 60°, for example. In other words, a light source e.g. for an office lighting system must be anti-glared toward large emission angles.

In conventional organic light-emitting diodes, this is achieved e.g. in that a beam forming foil is placed on to the organic light-emitting diode or in that the organic light-emitting diode is provided with a light-scattering layer. However, such beam forming foils or scattering layers reduce a light outcoupling efficiency of radiation out of the organic light-emitting diode. For this reason, a system of an organic light-emitting diode and a beam forming foil or a scattering layer has a comparatively low efficiency.

In the organic light-emitting diode described herein, suppressing the glare is achieved by the circumferential reflector. In this case, a larger effective radiation surface is produced by the reflector in a targeted manner, thus achieving a targeted etendue enlargement. To keep a component efficiency high here, and minimize a component size as far as possible, the reflector is formed such that a minimum reflector height and reflector surface are observed, the latter viewed in a plan view. Thus, the anti-glared luminaires described herein are more efficient compared to conventional luminaires having organic light-emitting diodes.

The emission surface may be located completely within the radiation surface, in a plan view. In other words, the emission surface is surrounded by an area of the radiation surface and of the reflector with a width>0 on all sides, e.g. with a strip having a width of at least 2 mm or 5 mm or 10 mm or at least 1% or 2% or 5% of an average diameter of the emission surface.

A distance between an outer edge of the radiation surface and an outer edge of the emission surface may be constant around the entire emission surface, in a plan view. In other words, the reflector forms a strip having a constant width around the emission surface, in a plan view.

The radiation surface and the emission surface in each case may be circular surfaces. Preferably, both circular surfaces have one and the same center.

The height of the reflector around the emission surface may be constant. In this case, the reflector preferably bounds both the radiation surface and the emission surface.

The relation $H=\tan(90°-a)$ L may apply to every longest intersection line and on all sides around the emission surface, in particular with a tolerance of at most 10% or 5% or 2% or 1% or 0.5% or exactly, within manufacturing tolerances. This can mean that the height of the reflector varies around the emission surface in a non-rotation-symmetric emission surface.

The radiation surface and the emission surface may each be rectangular surfaces. It is possible here that the radiation surface and the emission surface have a common centroid, in particular a common intersection of the diagonals. It is possible here that the height of the reflector exhibits a local maximum at the corners of the rectangular surfaces. On the centers of the side surfaces of the rectangles, the height of the reflector is preferably in each case minimal. Starting from these minima, the height increases toward the corners in each case monotonically or strictly monotonically.

The glare angle may be at least 30° or 40° or 45° or 50° or 55°. Alternatively or in addition, the glare angle is at most 85° or 80° or 75° or 70° or 65°. Particularly preferably, the glare angle is at 60°.

The emission surface of the light-emitting diode may be formed by a light exit surface of the light-emitting diode. The light exit surface is a surface of a substrate of the light-emitting diode that emits light, for example. The light exit surface is a plane or planar boundary surface of the light-emitting diode, which is formed by a solid material.

The light exit surface of the light-emitting diode may be formed to be curved. Thus, the light-exit surface of the light-emitting diode is different from the emission surface of the light-emitting diode.

In a plan view, at least one of the following relations may apply to the average diameter D of the emission surface and the height H of the reflector: $H/D\leq 10$, wherein the average diameter D is at least 1 cm and/or 6 cm at most then; $H/D\leq 1.5$, wherein the average diameter D is preferably greater than 6 cm and/or 40 cm at most then; $H/D\leq 0.3$, wherein the average diameter D is above 40 cm.

The reflector may be formed by two or more than two straight line portions with different slopes, in a cross-sectional view. These straight line portions connect with one another by a kink.

The kink, via which the exactly two straight line portions may connect to one another, is at least 15% or 20% and/or at most 50% or 40% or 30% along the height of the reflector. In other words, the kink is located closer to the emission surface than to the radiation surface.

The kink may result in a change of direction of at least 3° or 5° or 7° and/or 15° or 12° or 8° at the most. In other words, the kink is only a moderate directional change of the straight line portions of the reflector.

The reflector may be a specular-reflecting reflector. In other words, the reflector does not reflect in a diffuse manner, but mirroring normally. An average reflectivity of the reflector for the light generated in the light-emitting diode, alternatively or in addition, is at least 90% or 94% or 96%. For example, the reflector comprises a coating of aluminum or silver. Just as well, the reflector can be provided with a dielectric layer sequence for reflecting the generated light.

Furthermore, an assembly is provided. The assembly includes multiple luminaires, as provided in conjunction with one or multiple of the above-mentioned example. Features or the luminaire are therefore also disclosed for the assembly and vice versa.

It at least one example of the assembly, the luminaires are arranged in a common plane. Within the plane, the luminaires are arranged next to one another and preferably do not overlap in a plan view. It is possible for the luminaires to be provided densely packed in the assembly and within this plane so that only a small gap, e.g. with a medium width of at most 10% or 5% of a medium diameter of the radiation surfaces is formed between neighboring luminaires. Just as well, neighboring luminaires, in particular radiation surfaces, may contact one another in places or on all sides. Particularly preferably, the assembly includes a plurality of luminaires with rectangular, circular or hexagonal radiation surfaces.

Hereinafter, a luminaire described herein as well as an assembly described herein will be explained in greater detail by examples with reference to the drawings. Here, the same reference characters indicate the same elements in the individual figures. However, references are not to scale, and individual elements can be shown with an exaggerated size for a better understanding.

One example of a luminaire 1 is illustrated in a plan view in FIG. 1A, in a sectional illustration in FIG. 1B as well as in a functional diagram in FIG. 1C.

The luminaire 1 includes an organic light-emitting diode 2. In a plan view, the organic light-emitting diode 2 comprises a circular light exit surface 20, which is formed planar and plane. An effective emission surface E of the light-emitting diode 2 is also formed by the light exit surface 20. A reflector 5 is located around the light-emitting diode 2 on all sides. In a plan view, the reflector 5 extends around the light exit surface 20 at a constant width so that the reflector 5 has a circular outer edge and a circular inner edge, in a plan view.

In a plan view, a radiation surface F of the luminaire 1 is formed by the reflector 5 together with the light exit surface 20 constituted of the emission surface E. The radiation surface F is a planar, virtual surface. The radiation surface F is thus defined by the reflector 5 extending from the emission surface E, 20 toward the radiation surface F.

In a cross-sectional view, the reflector 5 is formed concave so that a width of the reflector 5 continuously increases in the direction away from the emission surface E, 20. To that end, in a cross-sectional view, the reflector 5 has in each case two straight line portions, which are separated from one another by a kink 6. Through the reflector 5, it is achieved that a glare angle a is observed. In other words, light will not emerge from the luminaire 1 at angles greater than the glare angle a to a perpendicular 3 of the emission surface E, 20 out of the luminaire 1. On the one hand, this is achieved by a height H of the reflector 5 and by the concave shape of the reflector 5 as well as by the width of the reflector 5.

To achieve high efficiency and a low component height, the size of the radiation surface and the height H of the reflector 5 depend on the size and the shape of the emission surface E. Thus, the following relation applies to a radius $r_F$ of the radiation surface F with respect to a radius $r_E$ of the emission surface E depending on the glare angle a: $r_F=r_E/\sin(a)$. The emission surface E, 20, which is circular in a plan view has a diameter D. The diameter D is twice the radius $r_E$.

The height H of the reflector 5 results from a length L of an intersection line 4, wherein the intersection line 4 is located within a plane of the emission surface E. Here, the length L is determined starting from a point X, at which the height of the reflector 5 is to be determined. Starting from this point X, the length L reaches all the way to an opposite farthest intersection of the intersection line 4 with an outer edge of the emission edge E, see point Y. Furthermore, starting from point Y and across point X, the length L reaches to an outer edge of the radiation surface F, which is located in point X. A point Z is formed by the intersection line 4 with the outer edge of the radiation surface F. Thus, the length L reaches from point Y to the point Z, i.e. from the edge of the emission edge E facing away from the reflector to the edge of the facing radiation surface F, in a plan view. Thus, the following relation applies to the height H of the reflector 5 in point X: $H=L\tan(90°-a)$, which in this case is equal to $H=(r_F+r_E)\tan(90°-a)$ and thus $H=r_E(1+1/\sin(a))\tan(90°-a)$.

The glare angle a is e.g. predetermined by the purpose of the luminaire 1, which purpose may be defined as an office lighting system.

Figure 2:
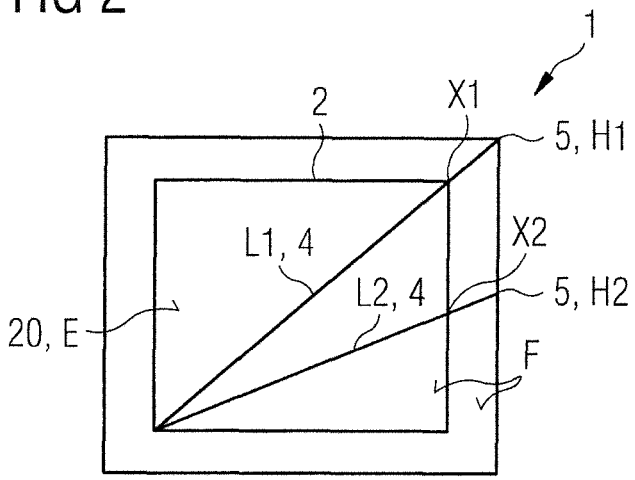
Figure 3:
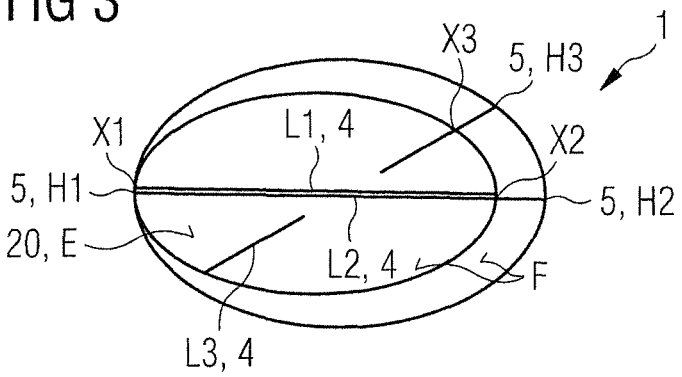
Figure 4:
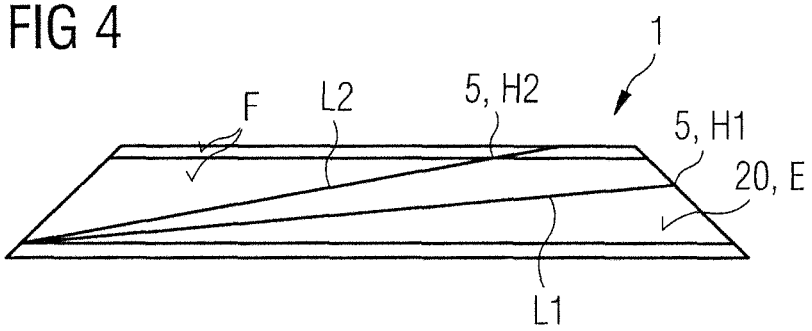

Plan views of further examples of the luminaire 1 are shown in FIGS. 2 to 4, respectively. The illustration of FIGS. 2 to 4 is analogous to the illustration of FIG. 1A.

In FIG. 2, the emission surface E and the radiation surface F are each formed by rectangles or squares. The reflector 5 surrounds the emission surface E on all sides in a strip with a constant width. The radiation surface F is equal to the emission surface E, divided by $\sin^2(a)$, with a being 60°, for example. Since heights H1, H2 of the reflector 5 in points X1, X2 at corners as well as within side edges on the emission surface E are in each case proportional to the lengths L1, L2 of longest intersection lines 4, the heights of the reflector 5 vary around the emission surface E.

The respective heights H1, H2 of the reflector 5 in the points X1, X2 each result from $\tan(90°-a)$ multiplied by the associated length L1, L2 of the respective longest intersection line 4.

In the example of FIG. 3, the emission surface E and the radiation surface F are each formed ellipsoid, in a plan view. Here, the emission surface E is arranged in the radiation surface F and the emission surface E contacts the outer edge of the radiation surface F in a point X1. Thus, the radiation surface F has a width of 0 in point X1. Thus, the associated straight line portion L1 is exclusively determined by the emission surface E. At an opposite side in point X2, the reflector height H2 is determined by the length L2 of the intersection line 4, which relates to both the emission surface E and the radiation surface F. The same applies to the height H3 in point X3. However, in contrast to what is shown in FIG. 3, the emission surface E is located centrally within the radiation surface F.

In the example of FIG. 4, the luminaire 1 is formed like a regular trapezoid, in a plan view. On face sides, the reflector 5 is oriented perpendicular to the emission surface E so that a width of the radiation surface F is 0 on the face sides then. The reflector 5 has a regular width unlike zero on both longitudinal sides. The calculation of the respective heights H1, H2 of the reflector 5 is effected analogously to the FIGS. 1 to 3.

To determine the respective height of the reflector 5 at a certain point around the emission surface E, in particular the following is done.

First, the glare angle a predetermined by the use is determined or set. After that, it is determined how large the radiation surface F has to be based upon the emission surface E predetermined by the organic light-emitting diode 2. Furthermore, the basic shape of the radiation surface F is predetermined and then the radiation surface F is shaped to the emission surface E based upon the determined surface area. Subsequently, the height of the reflector is determined by the length of the respective longest intersection lines for each point around the emission surface E.

Figure 5:
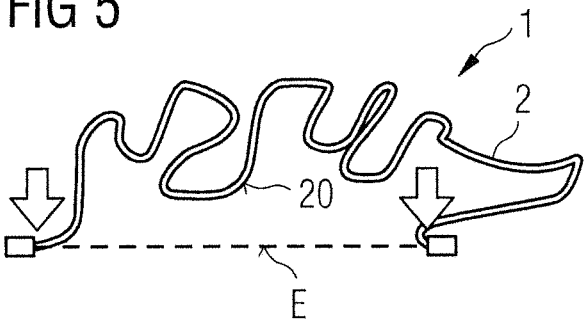
Figure 6:
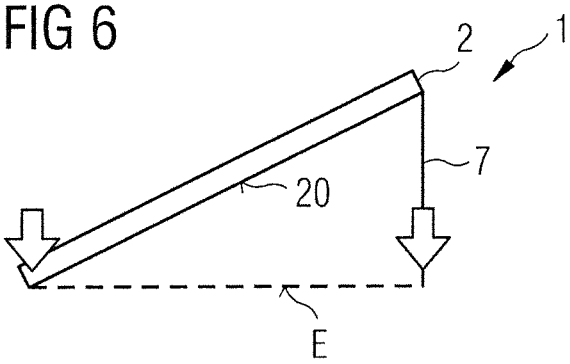
Figure 7:
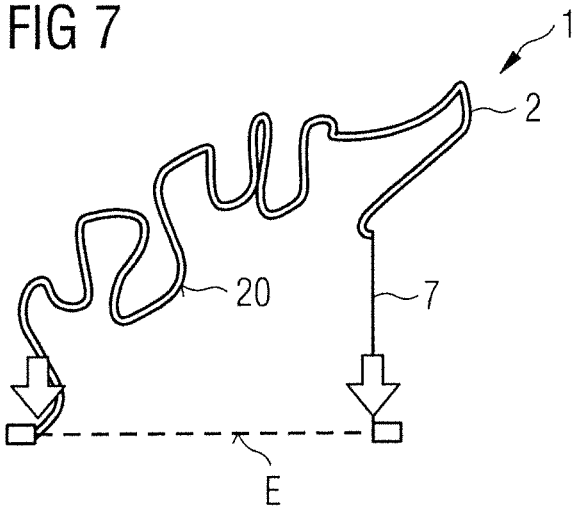

FIGS. 5 to 7 each show schematic sectional illustrations of the luminaire, in which the reflector is not drawn for the sake of simplicity. Here, the light exit surfaces 20 of the light-emitting diodes 2 are each different from the emission surface E. The emission surface E is each constructed in that an end plane is placed on the light exit surface 20. Thus, the emission surface E is the surface from which light emerges from the light-emitting diode 2 in a plan view, see particularly FIG. 5.

According to FIG. 6, the light-emitting diode 2 comprises a plane light exit surface 20, which however is oriented obliquely to the emission surface E. A cover element 7 is attached in regions between the light exit surface 20 and the emission surface E. The cover element 7 is impermeable to light and preferably diffusely reflective. In particular, the cover element 7 comprises a surface facing the organic light-emitting diode 2 that has a Lambert's emission characteristic in reflection. In the example in FIG. 6 as well, radiation is exclusively emitted from the light-emitting diode 2 through the emission surface E.

The same applies to FIG. 7, according to which the light exit surface 20 has a curved design. Again, a cover element 7 is provided between the light exit surface 20 and the emission surface E, which prevents emission of light in regions outside the emission surface E.

Figure 8:
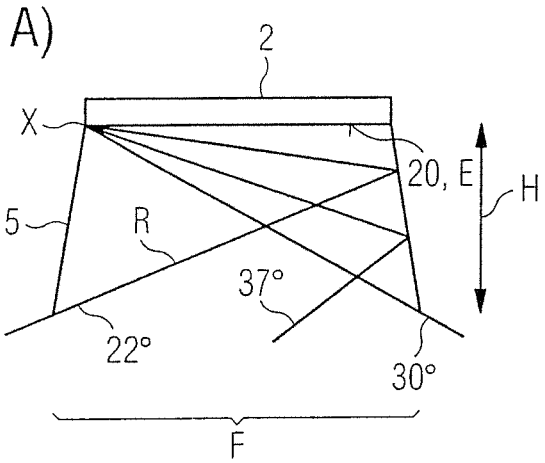
Figure 8:
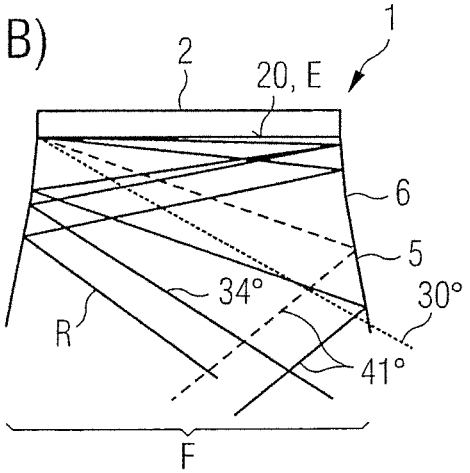

FIG. 8 shows sectional illustrations of reflectors 5, see FIG. 8A of a modification and FIG. 8B of a luminaire 1. It can be discerned in FIG. 8A that the reflector 5 is formed by one single straight line section, in a cross-sectional view. As a result, a critical emission angle of 30° results for the radiation R, starting from a point X at a corner of the emission surface E. However, by specular reflection on the reflector 5, even beams at a significantly smaller angle can be emitted, e.g. 22°.

This is prevented by the kink 6 in the reflector 5, as shown in FIG. 8B. Incidentally, the radiation surface F as well as the height H of the reflector 5 are set as described in conjunction with FIGS. 1 to 4. Once the emission surface E has been determined, as explained in conjunction with FIGS. 5 to 7, the further determination of the radiation surface F as well as the height H of the reflector 5 is effected in the same way, as indicated in conjunction with FIGS. 1 to 4.

Figure 9:
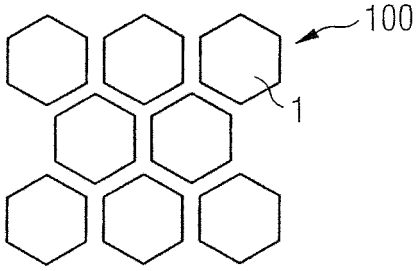
FIGS. 9A-9C are schematic plan views of assemblies having luminaires described herein.
Figure 9:
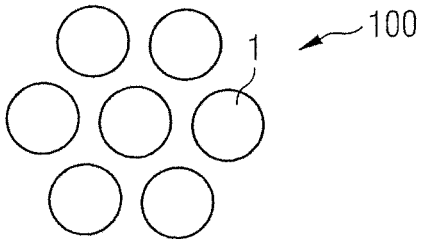
Figure 9:
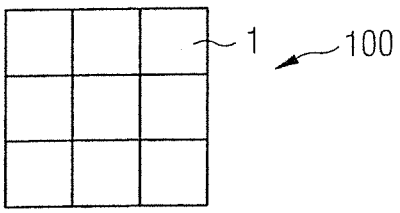

FIG. 9 shows examples of assemblies 100 with luminaires 1 in schematic plan views. According to FIG. 9A, the luminaires 1 have a hexagonal basic shape in a plan view. The luminaires 1 are arranged equidistantly to one another. Here, the luminaires 1 are located in a common plane. Thus, all luminaires 1 particularly preferably have the same glare angle a with respect to this common plane. The entire assembly 100 is thus free of glare on a certain, predetermined angular range.

According to FIG. 9B, the individual luminaires 1 have a circular basic shape in a plan view. The individual luminaires 1 are arranged at a distance to one another in a regular pattern. In contrast hereto, it is possible, as well as in all other examples, that the luminaires 1 are arranged irregularly.

In the example of FIG. 9C, the individual luminaires 1, viewed in the basic shape, are formed as squares and contact one another so that a contiguous light-emitting surface is formed by the assembly 100.

The individual luminaires 1 within the assembly 100 can be controllable independently from one another. However, preferably, all luminaires 1 are together electrically controllable within the assembly 100 so that no separation in independent luminaire zones is present. In particular, all luminaires 1 can be turned on an off together as well as dimmed together and in a correlated manner.

My luminaires are not limited to the examples by the description. This disclosure rather includes any new feature as well as any combination of features, which particularly includes any combination of features in the appended claims, even if the features or combination is not per se explicitly stated in the claims or the examples.

This application claims priority of DE 10 2015 105 835.9, the subject matter of which is incorporated herein by reference.

The invention claimed is:

1. A luminaire comprising:

a surface light source that emits light with a plane, effective emission surface E, from which the light generated in the surface light source is radiated, a reflector configured to suppress glare of the surface light source for emission angles above a glare angle a, with $40° \leq a \leq 80°$, and a plane, effective radiation surface F, from which light emitted by the surface light source emerges from the luminaire, wherein the emission surface is surrounded on all sides by the reflector and the reflector, starting from the emission surface, extends towards the radiation surface, the reflector, in a cross-sectional view perpendicular to the emission surface, is formed concave on average so that a width b of the reflector in a direction away from the emission surface is described by a function f (b) and the first derivative f'(b) thereof increases either strictly monotonically or as an alternative monotonically as well as strictly monotonically in some places in the direction away from the emission surface, it applies with a tolerance of 5% at most:

$$F=E/\sin^2(a) \text{ with } E \geq 1 \text{ cm}^2,$$

on at least one intersection line parallel to and in the emission surface, it applies for a height H of the reflector in the direction perpendicular to the emission surface with a tolerance of 10% at most: $H=\tan(90°-a)$ L, and L is a length of the intersection line from an edge of the emission surface facing away from the reflector to the edge of the facing radiation surface, in a plan view.

2. The luminaire according to claim 1, wherein the surface light source is an organic light-emitting diode.

3. The luminaire according to claim 2, wherein the emission surface is a light exit surface of the organic light-emitting diode, and the light exit surface is formed plane and planar.

4. The luminaire according to claim 2, wherein a light exit surface of the organic light-emitting diode is formed curved, and the light exit surface is different from the emission surface.

5. An assembly having a plurality of the luminaires according to claim 2, wherein the luminaires are arranged laterally next to one another in a common plane.

6. The luminaire according to claim 1, wherein the relation $H=\tan(90°-a)$ L applies with a tolerance of at most 10% for each longest intersection line, on all sides around the emission surface, and the reflector, in a plan view, completely fills a differential surface between the emission surface and the radiation surface and the reflector is restricted to the differential surface here.

7. The luminaire according to claim 1, wherein the emission surface, in a plan view, is located completely within the radiation surface.

8. The luminaire according to claim 1, wherein a distance between the edge of the radiation surface to the edge of the emission surface is constant on all sides around the entire emission surface, in a plan view.

9. The luminaire according to claim 1, wherein the radiation surface and the emission surface are each circular surfaces, and the height of the reflector is constant on all sides and the reflector bounds the radiation surface and the emission surface on all sides.

10. The luminaire according to claim 1, wherein the radiation surface and the emission surface are each rectangular surfaces, and the height of each reflector exhibits a local maximum at corners of the rectangular surfaces.

11. The luminaire according to claim 1, that satisfies: $55° \leq a \leq 65°$.

12. The luminaire according to claim 1, wherein for an average diameter D of the emission surface and for the height H of the reflector: $H/D \leq 10$ for $0.01\ m \leq D \leq 0.06\ m$ and $H/D \leq 1.5$ for $0.06\ m < D \leq 0.4\ m$ and $H/D \leq 0.3$ for $D > 0.4\ m$.

13. The luminaire according to claim 1, wherein a width of the reflector increases strictly monotonically viewed in the cross-section and in the direction away from the emission surface.

14. The luminaire according to claim 1, wherein the reflector, in a cross-sectional view, is formed by two straight line portions with different slopes connected to one another by a kink, and the kink is located 15% to 40% along the height of the reflector and the kink means a change of direction of 3° to 12°.

15. The luminaire according to claim 1, wherein the reflector reflects in a specular manner and an average reflectivity of the reflector for the light generated in the light-emitting diode is at least 94%.

16. A luminaire comprising:

an organic light-emitting diode that emits light with a plane, effective emission surface E, from which the light generated in the organic light-emitting diode is radiated, a reflector configured to suppress glare of the light-emitting diode for emission angles above a glare angle a, with $40° \leq a \leq 80°$, and a plane, effective radiation surface F, from which the light emitted by the light-emitting diode emerges from the luminaire, wherein the emission surface is surrounded on all sides by the reflector and the reflector, starting from the emission surface, extends towards the radiation surface, the reflector, in a cross-sectional view perpendicular to the emission surface, is formed concave on average so that a width b of the reflector in the direction away from the emission surface is described by a function f (b) and the first derivative f' (b) thereof increases either strictly monotonically or as an alternative monotonically as well as strictly monotonically in some places in the direction away from the emission surface, it applies with a tolerance of 5% at most:

$$F = E/\sin^2(a) \text{ with } E \geq 1\ cm^2,$$

on at least one intersection line parallel to and in the emission surface, it applies for a height H of the reflector in the direction perpendicular to the emission surface with a tolerance of 10% at most: $H = \tan(90° - a)\ L$, and L is a length of the intersection line from an edge of the emission surface facing away from the reflector to the edge of the facing radiation surface, in a plan view.

* * * * *